US005898978A

United States Patent [19]

Hollingsworth et al.

[11] Patent Number: 5,898,978

[45] Date of Patent: May 4, 1999

[54] METALLIC CLOTHING FOR CARDING SEGMENTS AND FLATS

[75] Inventors: John D. Hollingsworth, Greenville; Heyward O. Cannon, Taylors, both of S.C.

[73] Assignee: John D. Hollingsworth on Wheels, Inc., Greenville, N.C.

[21] Appl. No.: 09/084,149

[22] Filed: May 26, 1998

Related U.S. Application Data

[63] Continuation-in-part of application No. 08/810,282, Mar. 3, 1997, Pat. No. 5,755,012.

[51] Int. Cl.[6] ..... D01G 15/88

[52] U.S. Cl. ..... 19/114; 19/98

[58] Field of Search ..... 19/98, 99, 102, 19/104, 110, 111, 113, 114, 112

[56] References Cited

U.S. PATENT DOCUMENTS

| | | | |
|---|---|---|---|
| 54,450 | 5/1866 | Waite . | |
| 83,179 | 10/1868 | Lawrence . | |
| 397,265 | 2/1889 | Ashworth . | |
| 495,694 | 4/1893 | Duesberg-Delrez . | |
| 564,052 | 7/1896 | Deiss . | |
| 906,993 | 12/1908 | Bates . | |
| 2,937,413 | 5/1960 | Hollingsworth | 19/114 |
| 3,204,297 | 9/1965 | Wada | 19/114 |
| 3,419,941 | 1/1969 | Moriwaki | 19/234 |
| 4,221,023 | 9/1980 | Henderson | 19/113 |
| 4,398,318 | 8/1983 | Ashworth | 19/114 |
| 4,528,724 | 7/1985 | Bisquolm | 19/113 |
| 4,625,367 | 12/1986 | Sole-Leris | 10/113 |
| 4,651,387 | 3/1987 | Giuliani | 19/113 |
| 4,653,152 | 3/1987 | Wada | 19/114 |
| 5,230,124 | 7/1993 | Booth | 19/112 |
| 5,423,176 | 6/1995 | Stahlecker | 57/408 |
| 5,467,505 | 11/1995 | Graf | 19/114 |
| 5,581,848 | 12/1996 | Egerer | 19/114 |

FOREIGN PATENT DOCUMENTS

| | | |
|---|---|---|
| 1484526 | 5/1867 | Japan . |
| 2165561 | 10/1984 | United Kingdom . |

*Primary Examiner*—John J. Calvert
*Assistant Examiner*—Larry D. Worrell, Jr.
*Attorney, Agent, or Firm*—Leatherwood Walker Todd & Mann, P.C.

[57] ABSTRACT

Metallic clothing having metallic wire teeth bent at a double angle. The lower portion of each tooth is angled by an first angle with respect to vertical, and the upper portion is angled at a second angle with respect to vertical. The upper portion terminates at the tip, or point, of the tooth. This double-angle tooth profile is angled in the direction opposite to the general direction of travel of fibers being carded. The upper side portion of each tooth is tapered inwardly to the tip, and the rear edge of the upper end of each tooth may be provided with a forward curvature towards the point of the tooth. Alternate embodiments include single angled teeth and a double-angled teeth, each having a base portion substantially the same height as the teeth.

16 Claims, 5 Drawing Sheets

METALLIC CLOTHING FOR CARDING SEGMENTS AND FLATS

This application is a continuation-in-part of application Ser. No. 08/810,282, filed Mar. 3, 1997, now U.S. Pat. No. 5,755,012.

BACKGROUND OF THE INVENTION

This invention relates generally to metallic clothing with teeth having a double-angled profile, a tapered tip, and a radiused point for use on carding segments and carding flats.

Carding flats and stationary carding segments are generally used in carding machines about the main carding cylinder and produce a carding interface therebetween. Carding flats may also remove trash and non-spinnable fibers during carding. Conventional carding flats often involve the use of flexible wire clothing, which is attached to the flats themselves via adhesive, or some other fastening means. The flexible clothing is produced by providing a flexible substrate, which could be fabric, rubber, plastic, leather, or some combination thereof. The wire clothing is essentially "stapled" through the substrate. After the staples have been inserted through the substrate, the ends of the staples, i.e., the "wires," are subsequently bent at a forward angle and are ground to produce a desired profile.

Production of flexible clothing is relatively labor-intensive and expensive because of the required bending and grinding of the wires after their insertion through the substrate.

Metallic clothing is also known. Metallic clothing does not require a pliable substrate as does flexible clothing, but instead is comprised of a series of wire segments which are stacked side-by-side against each one another in a channel formed in an elongated holder. This holder can be produced of a material such as plastic, or some other material, and is subsequently attached to the flat or carding segment itself via adhesive, clips, or some other fastening means. The advantages of metallic wire clothing are that it is easier to produce and offers longer life. However, in certain applications metallic clothing may tend to not remove trash and non-spinnable fibers as well as does conventional flexible card clothing.

Accordingly, there exists a need for metallic clothing having an improved ability to remove trash and non-spinnable fibers.

SUMMARY OF THE INVENTION

It is, therefore, the principal object of this invention to provide metallic clothing for carding segments and flats which offers both improved manufacturability and durability, and also, an improved ability to remove trash and non-spinnable fibers during carding.

Generally the present invention includes metallic clothing having metallic wire teeth bent at a double angle. The lower portion of each tooth is angled by an first angle with respect to vertical, and the upper portion is angled at a second angle with respect to vertical. The upper portion terminates at the tip, or point, of the tooth. This double-angle tooth profile is angled in the direction opposite to the general direction of travel of fibers being carded. The upper side portion of each tooth is tapered inwardly to the tip, and the rear edge of the upper end of each tooth may be provided with a forward curvature towards the point of the tooth. Additionally, the teeth of the present invention may be of generally taller height than that of conventional metallic clothing teeth.

The present invention further includes metallic clothing having wire teeth bent at a double angle, wherein the base portion of the wire clothing is taller than the embodiment discussed above and comprises approximately one-half the height of the overall height of the clothing, with the height of the teeth comprising the balance of the height of the metallic clothing.

Moreover, the present invention includes metallic clothing wherein the teeth are at a single angle, and wherein the height of the base portion of the wire clothing is substantially half the height of the clothing, with the height of the teeth making up the balance of the clothing's height.

BRIEF DESCRIPTION OF THE DRAWINGS

The foregoing, as well as other objects of the present invention, will be further apparent from the following detailed description of the preferred embodiment of the present invention, when taken together with the accompanying specification and the drawings, in which.

DESCRIPTION OF THE PREFERRED EMBODIMENT

Figure 1:
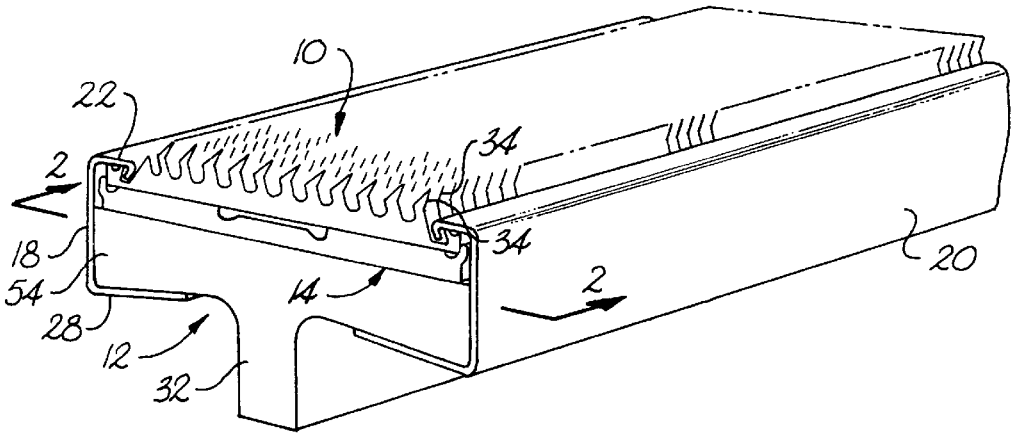
FIG. 1 is a partial perspective view of a carding flat or carding segment provided with metallic clothing constructed in accordance with the present invention.

The accompanying drawings and the description which follows set forth this invention in its preferred embodiment. However, it is contemplated that persons generally familiar with flexible and metallic clothing will be able to apply the novel characteristics of the structures illustrated and described herein in other contexts by modification of certain details. Accordingly, the drawings, description, and claims are not to be taken as restrictive on the scope of this invention, but are to be understood as broad and general teachings.

Referring now to the drawings in detail, wherein like reference characters represent like elements or features throughout the various views, the metallic clothing of the present invention is indicated generally in the figures by reference character 10.

Turning to FIG. 1, a perspective view of a carding flat or carding segment, generally 12, is illustrated, having metallic clothing, generally 10, provided thereon. Metallic clothing 10 is supported on a holder member, generally 14, and is held against member 14 by elongated clamps, or clips, 18, 20. Each clip 18, 20, includes an upper clamping portion, generally 22, for engaging the edge portions, generally 24, 26, of metallic clothing 10 and a lower clamping portion, generally 28, for engaging lower surfaces, generally 30, of flat 12. Flat 12 also includes an elongated rail portion 32 running substantially the length thereof.

Figure 2:
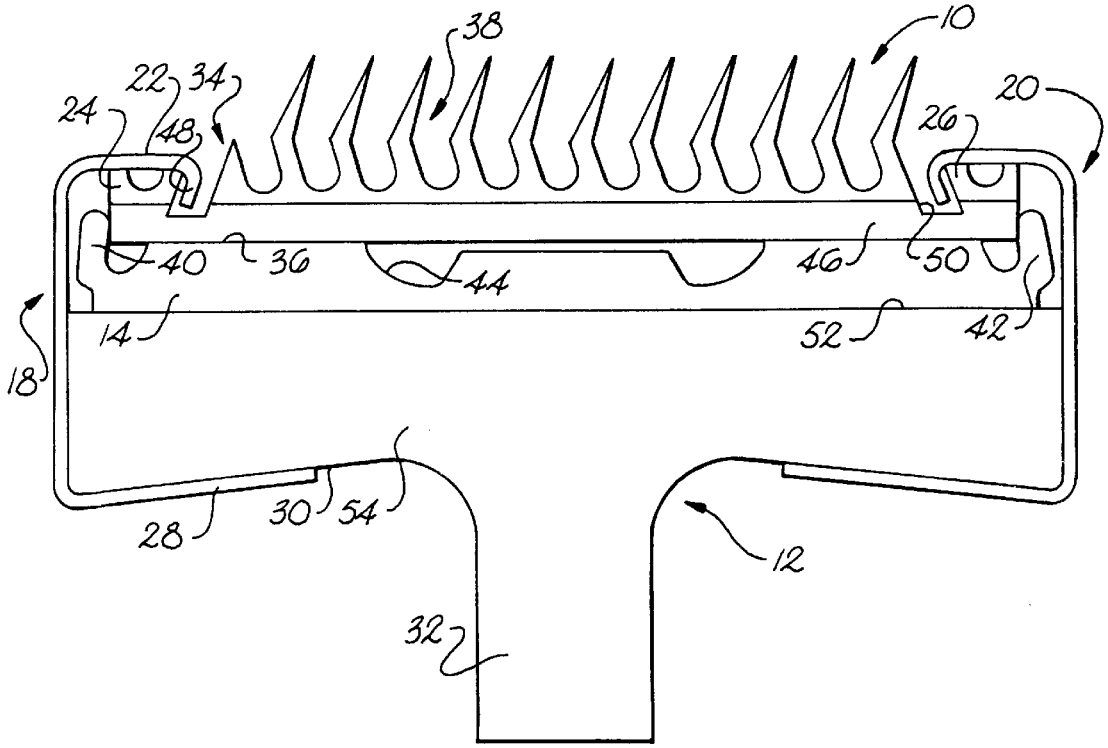
FIG. 2 is a sectional view taken along lines 2—2 of FIG. 1.

In FIG. 2, a sectional view of the flat 12 illustrated in FIG. 1 is shown. Metallic clothing 10 includes a plurality of segments, generally 34, which are stacked in a side-by-side relationship on upper surface 36 of holder member 14. Each wire segment 34 includes a plurality of teeth, generally 38, which are substantially identical with respect to one another. While wire segments 34 can be stacked in a side-by-side relationship along member 14 in a manner such that teeth 38 on adjacent segments are parallel with one another, (thereby producing uniform rows of teeth along the length of flat 12), it is to be understood that segments 34 can be manufactured such that teeth 38 on adjacent segments 34 are staggered with respect to one another to yield a predetermined pattern of teeth positioned across the width and length of flat 12. These teeth patterns could be any one of a variety of configurations.

Holder member 14 includes upstanding edges 40, 42, respectively, which engage end portions 24, 26, respectively, of wire segment 34. Member 14 is also provided with a recessed portion, generally 44, extending beneath the mid-portion of segment 34. Base portion 46 of the wire segment 34 rests upon upper surface 36 of member 14 and is also captured by edge portions 40, 42 of member 14.

Clamps 18, 20 include down-turned ends 48 which engage in slots 50 provided adjacent each end 24, 26 of wire segment 34 in order to securely fix wire segments 34 and member 14 with respect to upper surface 52 of the horizontal portion 54 of flat 12.

Figure 3A:
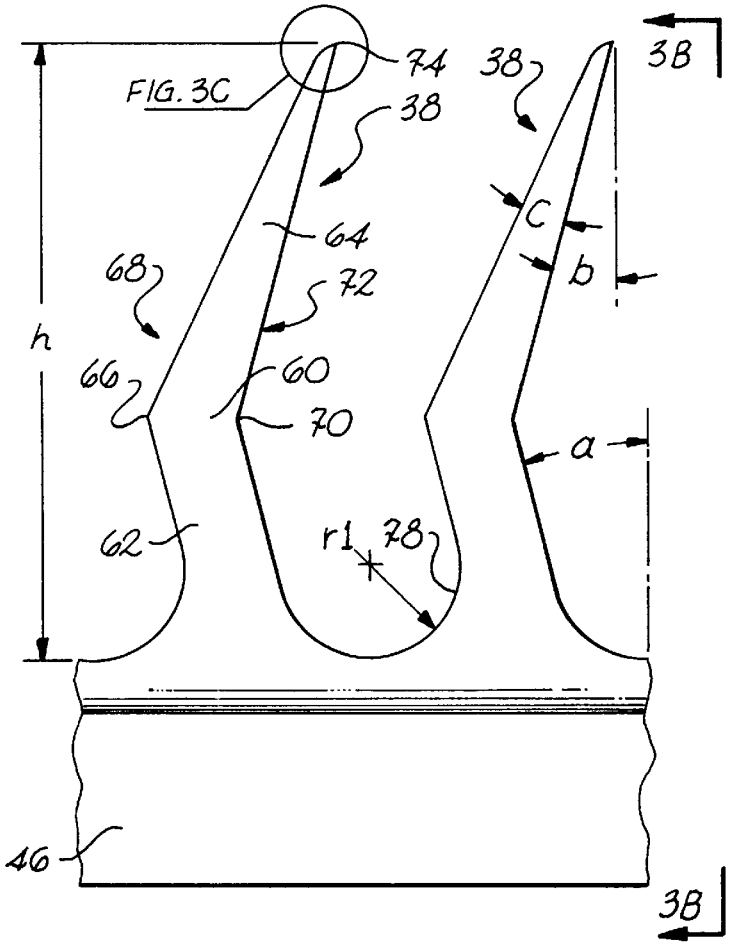
FIG. 3A is a partial side elevational view of metallic clothing teeth constructed in accordance with the present invention.

In FIG. 3A, an enlarged view of segment 34 of metallic clothing 10 is illustrated. Teeth 38 each include a body portion, generally 60, having a lower portion 62 and an upper portion 64. The lower portion 62 extends upwardly from base 46 at an angle a with respect to vertical. Angle a in one preferred embodiment is approximately 15 degrees, although it is to be understood that angle a could be a variety of different angles. Lower portion 62 extends upwardly and terminates into upper portion 64, where an elbow 66 is formed on the backside, generally 68, of tooth 38. Opposite elbow 66 is a corner 70 formed in the leading edge, generally 72, of tooth 38. Upper portion 64 extends at an angle b with respect to vertical. Angle b is preferably approximately equal to angle a, and in one embodiment is thus preferably approximately 15 degrees. However, it is to be understood that angle b could be a variety of different angles. Upper portion 64 terminates at the point 74 of tooth 38.

Upper portion 64 of tooth 38 preferably extends downwardly at an angle c from point 74 with increasing thickness. Angle c is approximately 10 degrees in one preferred embodiment, although angle c could be a variety of different angles.

Figure 3B:
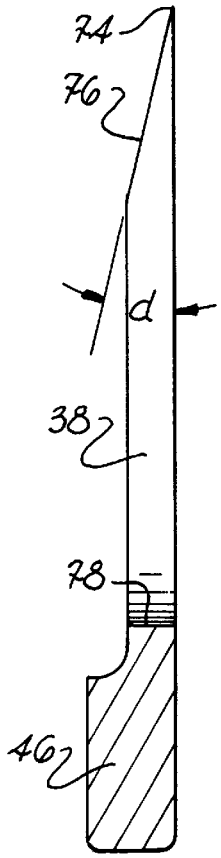
FIG. 3B is a sectional view taken along lines 3B—3B of FIG. 3A.

FIG. 3B illustrates a sectional view of a tooth 38 of metallic clothing 10 constructed in accordance with the present invention. As illustrated in FIG. 3B, upper portion 64 of tooth 38 is provided with a transversely angled upper portion 76 which is angled inwardly to point 74. Angle portion 76 is tapered inwardly at an angle d. Angle d is in one preferred embodiment approximately 10 degrees, although it is to be understood that it could be a variety of different angles.

Adjacent teeth on wire segment 34 include a radiused recess, or valley, 78 therebetween. Valleys 78 could be provided a curved profile having a radius $r_1$, if desired. Radius r, in one preferred embodiment is approximately 0.254 mm, but could be a variety of different lengths, depending on the particular application of clothing 10. The height h of tooth 38 preferably approximates the height of teeth used on flexable clothing, which is generally taller than that used on conventional metallic clothing.

Figure 3C:
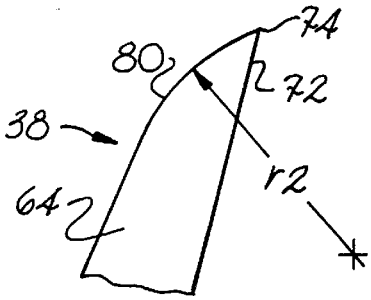
FIG. 3C is a partial side elevational view of the point of a metallic clothing tooth constructed in accordance with the present invention.

Turning to FIG. 3C, an enlarged view of the tip portion 74 of tooth 38 is illustrated. Tip portion 74 is provided with a portion 80 curved towards the leading edge 72 of tooth 38. The radius $r_2$ of curved portion 80 in one preferred embodiment is approximately 0.314 mm, but could be a variety of lengths, depending on the desired application of clothing 10.

Metallic clothing 10 is preferably constructed of steel, alloys, or any other suitable material, including material used to construct clothing found on carding cylinders of carding machines.

Angles a through d of clothing 10 could be varied as desired, depending on the fibers being carded, the type of carding machine being used, the flats or carding segment arrangements, etc.

The double-angled profile of metallic clothing 10 is anticipated to provide improved trash and non-spinnable fiber removal during carding, as compared to conventional metallic clothing. It is also anticipated that metallic clothing 10 may be manufactured more expeditiously and will be longer lasting than conventional flexible clothing.

Figure 5A:
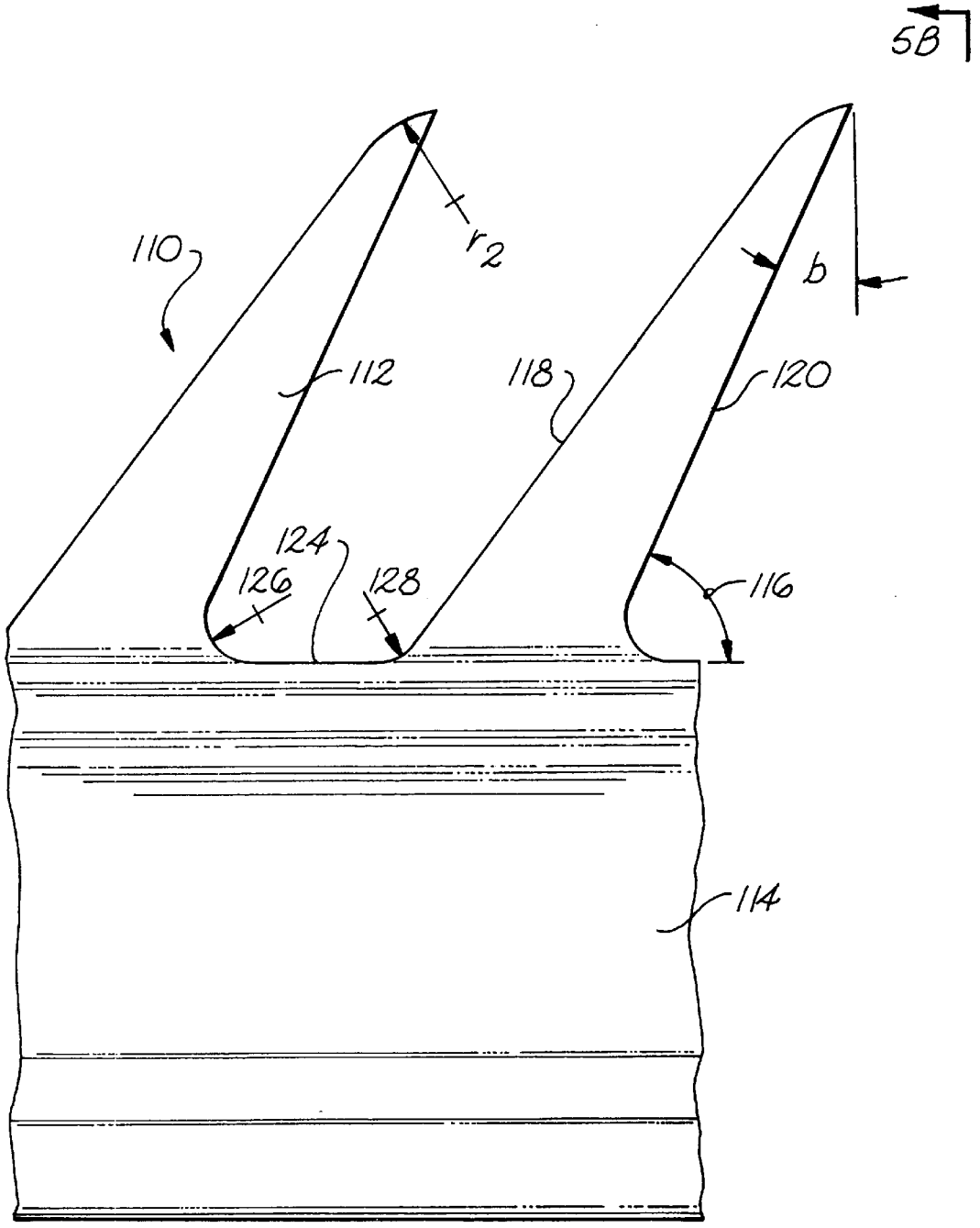
FIG. 5A is a partial side elevational view of a second alternate embodiment of metallic clothing teeth constructed in accordance with the present invention.
Figure 5B:
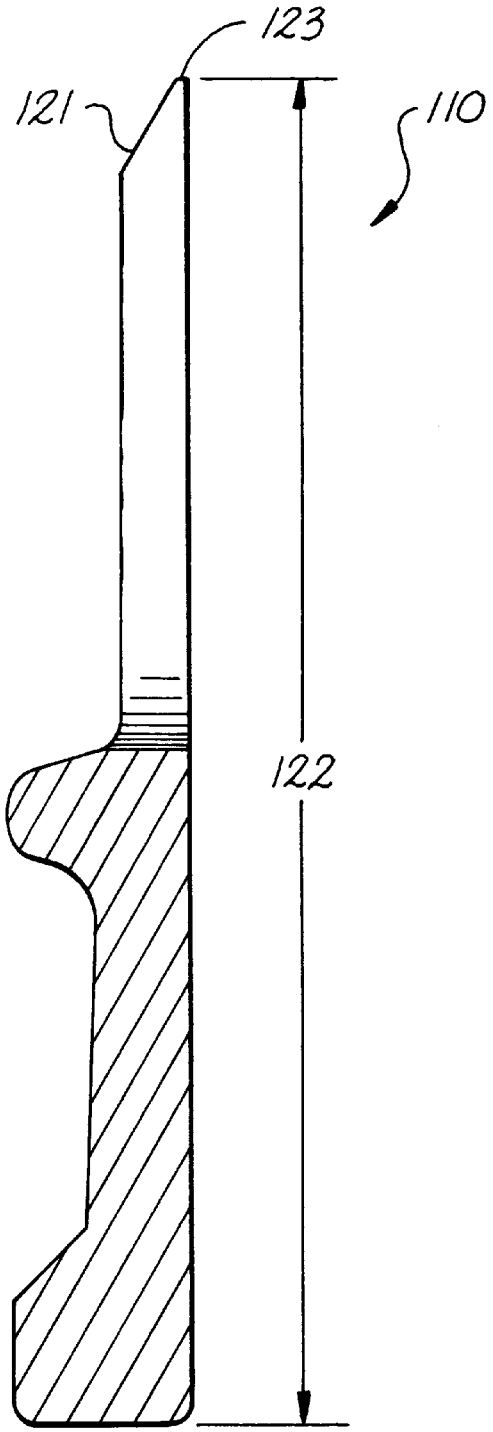
FIG. 5B is a sectional view taken along lines 5B—5B of FIG. 5A.

Turning now to the first alternate embodiment of the present invention, FIGS. 5A and 5B illustrate a variation of metallic clothing which is designated generally as 110. In this embodiment 110, teeth 112 are of a single angle rather than the double angle discussed above. Teeth 112 extend upwardly from base 114 at an angle 116 of approximately 45 to 75 degrees, and preferably at approximately 65 degrees. Like clothing 10 above, each tooth includes a backside portion 118 forwardly curved towards and substantially terminating in said leading edge 120 and further includes a side surface 121 transversely angled with respect thereto and terminating at tip portion 123.

Base 114 also differs in height with respect to base 46 of clothing 10, discussed above. Preferably, base 114 extends substantially one-half the height 122 of clothing 110, with teeth 112 extending upwardly from base 114 to the full height 122 of clothing 110.

Note also that valley 124, which is also the uppermost portion of base 114, between teeth 112 is relatively flattened at the central portion thereof and includes radiused portions 126, 128 which transition into leading edge 120 and trailing edge 130, respectively.

Clothing 110, because of its single angle design, has production advantages over the double angle clothing 10 in that it is easier to load onto a carding segment. Because clothing 110 has a taller base portion 114 (with respect to the base portion 46 height of clothing 10), this renders clothing 110 more stable and less likely to topple over when inserted side-by-side on a carding segment 12 during construction of a clothed carding segment 12.

Figures 4A, 4B:
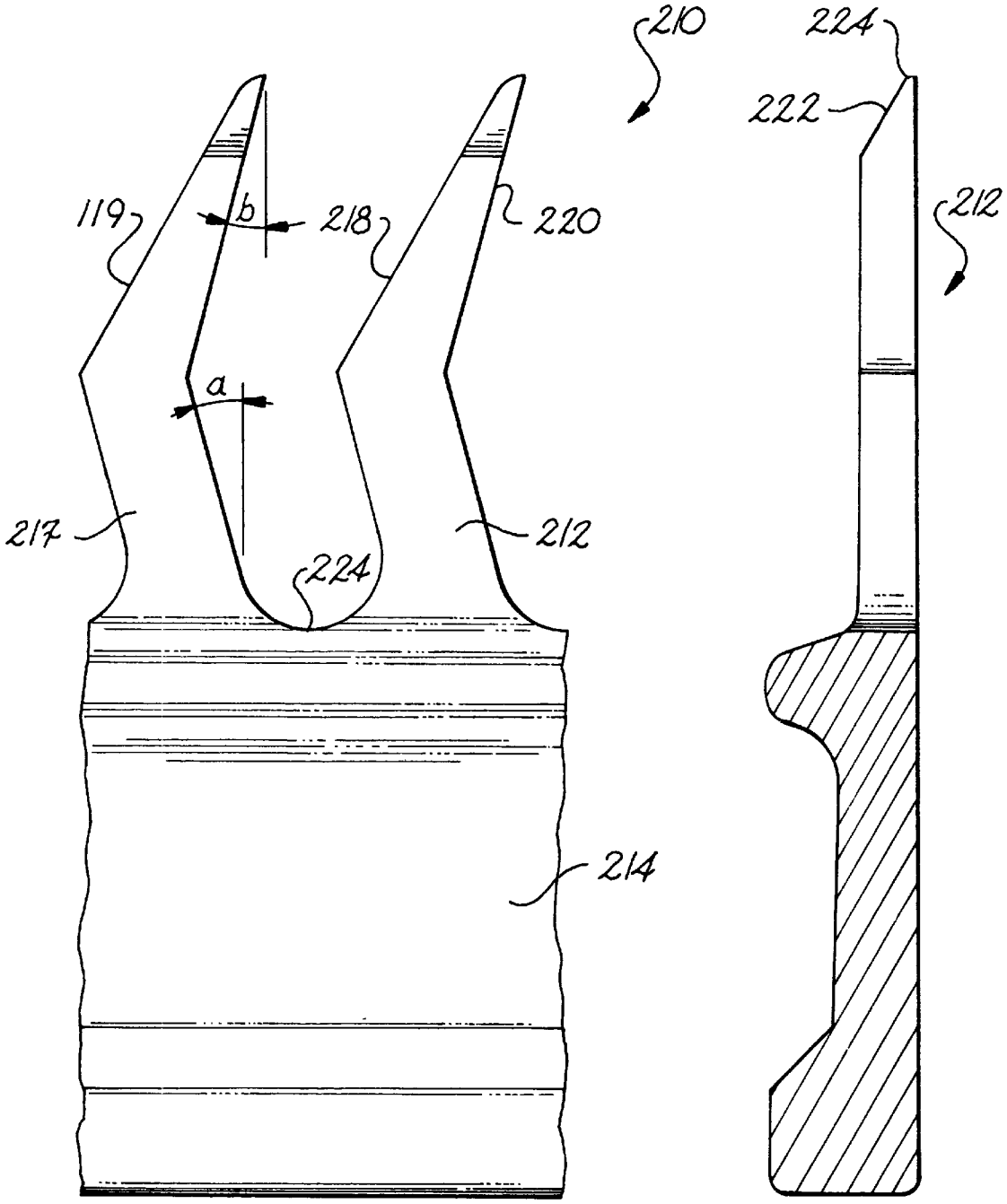
FIG. 4A is a partial side elevational view of a first alternate embodiment of metallic clothing teeth constructed in accordance with the present invention.
FIG. 4B is a sectional view taken along lines 4B—4B of FIG. 4A.

A further alternate embodiment 210 of metallic clothing constructed in accordance with the present invention is shown in FIGS. 4A and 4B. In this embodiment, clothing 210 has a combination of the features of clothing 10 and 110. Specifically, clothing 210 has double angled teeth 12 together with a base portion 214 of substantially one-half the height of the clothing 210. Teeth 112 extend upwardly from base 214 and include a lower portion 217 which extend at an angle a with respect to vertical, and an upper portion 219 which extends at an angle of b with respect to vertical. It is to be understood, however, that angles a and b are not required to be equal, and can be of differing values than the angles a and b set forth herein.

Like clothing 10 and 110 above, each tooth 212 includes a backside portion 218 forwardly curved towards and substantially terminating in said leading edge 220. Teeth 212 further each include a side surface 222 transversely angled with respect thereto and terminating at tip portion 224.

Base 214 also differs in height with respect to base 46 of clothing 10, discussed above. Preferably, base 214 extends substantially one-half the height 222 of clothing 210, with teeth 212 extending upwardly from base 214 to the full height of clothing 210.

Valleys 224 are radiused as are the valleys 78 of clothing 10, above.

Because of the combination of the double angled teeth 212 and the taller base portion 214, clothing 210 combines both the cleaning action of the double angled teeth of clothing 10 and the improved loading, or "packing", characteristics of clothing 110. Clothing segments 210 tend to be more stable when packed onto a carding segment, such as a flat, because of the proportionately larger, and hence more massive base portion 214. This tends to reduce toppling over of segments of the clothing 210 as it is loaded. Further, the taller base portion 214 allows segments of clothing 210 to be more easily manipulated during packing and to therefore more easily align adjacent segments of clothing 210 in a side-by-side relationship in a predetermined packing pattern.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present invention.

What is claimed is:

1. Metallic clothing for carding textile fibers, comprising:

a plurality of individual elongated metallic body members;

an elongated holder for holding said elongated metallic members side-by-side;

each of said metallic body members including a base portion having an uppermost portion, and a plurality of adjacent teeth extending upwardly from said uppermost portion of said base portion; said base portion and said teeth each being of a height substantially equal to one another;

each of said plurality of teeth being formed with a double angle, having a lower portion angled in a first direction at a first angle from vertical and an upper portion angled in a second direction at a second angle from vertical substantially opposite to said first direction.

2. The metallic clothing as defined in claim 1, wherein said upper portion of each of said plurality of teeth includes a leading edge portion for engaging fibers during carding and a tip portion adjacent said leading edge portion, and wherein said upper portion is transversely tapered-in towards said tip portion.

3. The metallic clothing as defined in claim 1, wherein said upper portion and lower portion of each of said plurality of teeth on an individual metallic body member are substantially co-planar.

4. The metallic clothing as defined in claim 1, wherein said upper portion of each of said plurality of teeth includes a leading edge and a backside portion forwardly curved towards and substantially terminating at said leading edge.

5. The metallic clothing as defined in claim 1, wherein said first angle and said second angle are of approximately equal magnitude as measured from vertical.

6. The metallic clothing as defined in claim 1, wherein said first angle is approximately 15 degrees.

7. The metallic clothing as defined in claim 1, wherein said second angle is approximately 15 degrees.

8. The metallic clothing as defined in claim 1, wherein said teeth on adjacent metallic members are substantially parallel with one another.

9. The metallic clothing as defined in claim 1, wherein said teeth on adjacent metallic members are substantially staggered with respect to one another.

10. The metallic clothing as defined in claim 1, further comprising an elbow portion connecting said upper and lower portion of each of said plurality of teeth together.

11. The metallic clothing as defined in claim 1, wherein said metallic members include a radiused valley between adjacent teeth.

12. The metallic clothing as defined in claim 1, wherein said elongated holder includes:

an elongated surface;

an elongated holding member carried on said elongated surface; and at least one elongated clip for holding said metallic members side-by-side on said elongated holding member and said elongated surface.

13. Metallic teeth for use in clothing for carding fibers approaching the metallic teeth, the metallic teeth comprising:

an elongated metallic body member;

said metallic body member including a base portion having an uppermost portion, and a plurality of adjacent teeth extending upwardly from said uppermost portion of said base portion; said base portion and said teeth each being of a height substantially equal to one another;

each of said plurality of teeth having a tip, a lower side surface, a first upper side surface, a second upper side surface opposite said first upper side surface, and an upper portion including a leading edge portion for engaging fibers during carding; and said first upper side surface portion being transversely angled with respect to said lower side surface towards said second upper side surface and substantially terminating at said tip.

14. The metallic teeth as defined in claim 13, wherein said upper portion of each of said plurality of teeth includes a leading edge and a backside portion forwardly curved towards and substantially terminating in said leading edge.

15. A carding segment for use in carding fibers, comprising:

a plurality of individual elongated metallic members;

an elongated surface;

an elongated holding member carried on said elongated surface; and at least one elongated clip for holding said elongated metallic members side-by-side on said elongated holding member and said elongated surface;

each of said metallic body members including a base portion having an uppermost portion and a plurality of adjacent teeth extending upwardly from said uppermost portion of said base portion; said base portion and said teeth each being of a height substantially equal to one another;

each of said plurality of teeth being formed with a double angle, having a lower portion angled in a first direction at a first angle from vertical and an upper portion angled in a second direction at a second angle from vertical substantially opposite to said first direction, said upper portion including a leading edge portion for engaging fibers during carding; and said upper portion being transversely angled inwardly with respect to said lower portion.

16. The carding segment as defined in claim 15, wherein said first angle and said second angle are of approximately equal magnitude as measured from vertical.

* * * * *